US008160283B2

(12) United States Patent
Saltykov et al.

(10) Patent No.: US 8,160,283 B2
(45) Date of Patent: Apr. 17, 2012

(54) HEARING AID RECEIVER WITH VIBRATION COMPENSATION

(75) Inventors: Oleg Saltykov, Fair Lawn, NJ (US); Fred McBagonluri, East Windsor, NJ (US)

(73) Assignee: Siemens Hearing Instruments Inc., Piscataway, NJ (US)

( * ) Notice: Subject to any disclaimer, the term of this patent is extended or adjusted under 35 U.S.C. 154(b) by 1251 days.

(21) Appl. No.: 11/696,435

(22) Filed: Apr. 4, 2007

(65) Prior Publication Data

US 2008/0247578 A1 Oct. 9, 2008

(51) Int. Cl.
*H04R 25/00* (2006.01)

(52) U.S. Cl. ..... 381/318; 381/418

(58) Field of Classification Search ..... 233/318, 233/324, 417–418

See application file for complete search history.

(56) References Cited

U.S. PATENT DOCUMENTS

| | | | | |
|---|---|---|---|---|
| 3,257,516 | A | 6/1966 | Shaler | |
| 4,109,116 | A | 8/1978 | Victoreen | |
| 6,078,677 | A | 6/2000 | Dolleman et al. | |
| 7,088,839 | B2 * | 8/2006 | Geschiere et al. | 381/368 |
| 2002/0146141 | A1 | 10/2002 | Geschiere et al. | |

* cited by examiner

*Primary Examiner* — Davetta W Goins
*Assistant Examiner* — Phylesha Dabney
(74) *Attorney, Agent, or Firm* — Francis G Montgomery

(57) ABSTRACT

In order to reduce feedback in a hearing aid, a hearing aid receiver is provided that comprises a housing having an inside surface and an outside surface, a motor, an active armature that is attached to the motor and attached to the inside surface of the housing, the active armature being driven in a vibrational manner by the motor, and an external passive component that is attached to the outside surface of the housing, the external passive component designed to vibrate in a direction opposed to vibrations of the active armature. A corresponding method for operating such a hearing aid receives is also provided.

8 Claims, 1 Drawing Sheet

HEARING AID RECEIVER WITH VIBRATION COMPENSATION

BACKGROUND

The present invention is directed to a hearing aid receiver that has a vibration compensation component, helping to reduce feedback and other problems associated with vibration.

A typical construction of a hearing aid receiver 10 is shown on FIG. 1. Its construction is described in, e.g., U.S. Pat. No. 6,078,677, herein incorporated by reference. The basic components of this receiver 10 include a U-shaped armature 20 that is driven by an electric coil 36 coupled with a magnetic member 38 that together comprise a motor. The motor is an electro-mechanical part of a transducer that takes an electrical input and produces a mechanical force/member velocity. A diaphragm layer 32 is provided with a reinforcement layer 30. The diaphragm, which is attached to the motor, converts the mechanical vibrations into sound pressure. These components are contained within a housing or case 42.

A simplified vibration model is shown in FIG. 2 in which the particularly relevant components are highlighted. Such a design can be implemented in a completely-in-canal (CIC) hearing aid, e.g. This model comprises a case 42 and a U-shaped armature 20 that is attached to the case 42 via an armature support 40, which may be implemented as, e.g., a rigid block (which may be implemented as a part of the motor). The motor 36, 38 of the receiver 10 creates forces that cause the U-shape armature 20 to vibrate: 1) a force applied to the U-shaped armature 50, and 2) a reaction force applied to the case 42 via the block 40.

The vibrating elements of the motor 36, 38 cause the receiver 10 itself to vibrate. In order to prevent a hearing aid from creating feedback, the receiver 10 has to be isolated from direct mechanical contact with the shell or other components inside the hearing instrument. The receiver 10 of a typical CIC instrument is placed inside the CIC shell and attached to the shell tip with a flexible tube (not shown). The tube feeds the sound pressure, generated by the receiver 10, into the ear of the user. The tube also isolates the vibrations that the receiver 10 creates from spreading into the CIC instrument.

A receiver 10 creates maximum amount of vibrations near the resonance frequency of the U-shaped armature 20 (typical value around 2-3 kHz), so that a typical hearing device may develop feedback near such a resonance frequency.

SUMMARY

A construction of a receiver according to various embodiments of the invention includes a vibrational compensation component having vibrational characteristics similar to the active/driven U-shaped armature.

Accordingly, a hearing aid receiver is provided, comprising: a housing having an inside surface and an outside surface; a motor; an active armature that is attached to the motor and attached to the inside surface of the housing, the active armature being driven in a vibrational manner by the motor; and an external passive component that is attached to the outside surface of the housing, the external passive component designed to vibrate in a direction opposed to vibrations of the active armature. The external passive component may mirror the shape of the active armature, and the external passive component may be attached to the outside surface of the housing in a direction of a mirror reflection of the active armature.

A corresponding method for operating a hearing aid receiver, comprising: actively vibrating an active armature that is attached to a motor within a housing, the housing having an inside surface and an outside surface; and passively vibrating a passive component that is attached to the outside surface of the housing in a direction opposite to vibrations of the active armature.

DESCRIPTION OF THE DRAWINGS

The invention is best understood with reference to various preferred embodiments as illustrated in the drawings and in the following descriptive text.

DETAILED DESCRIPTION OF THE PREFERRED EMBODIMENTS

Figure 1:
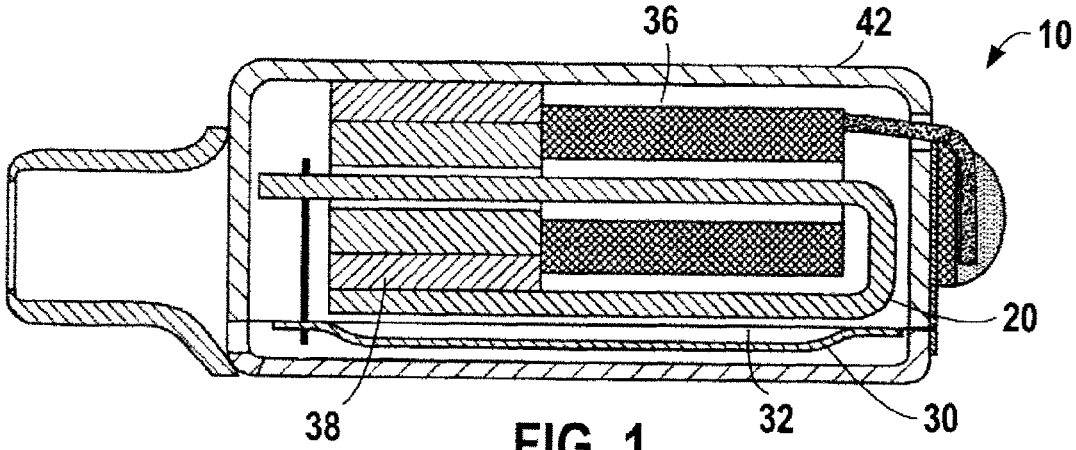
FIG. 1 (PRIOR ART)
FIG. 1 is side pictorial view of a known receiver design.
Figure 2:
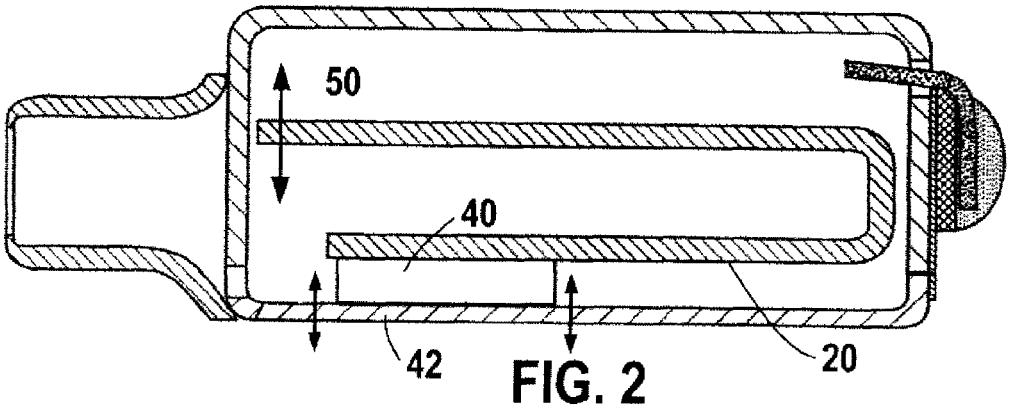
FIG. 2 (PRIOR ART)
FIG. 2 is side view of a simplified vibrational model of the hearing aid design model shown in FIG. 1.
Figure 3:
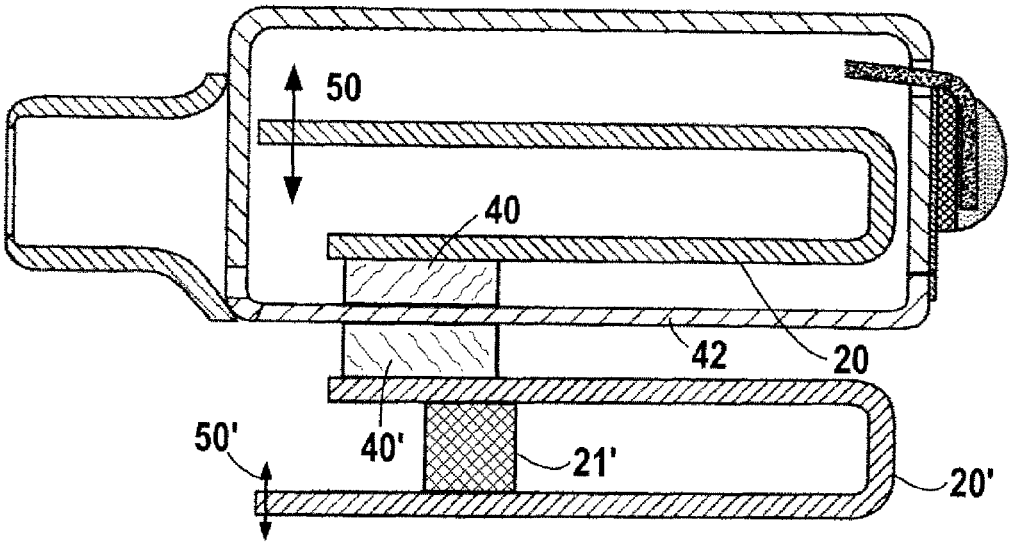
FIG. 3 is a side view of a receiver design having a compensation component.

FIG. 3 illustrates an embodiment of the inventive receiver 10 construction. According to this embodiment, the receiver 10 comprises the elements illustrated in FIG. 2, but further includes, in addition to the active or driven U-shaped armature 20, a passive U-shaped armature 20'. The passive U-shaped armature 20' is attached to the housing or receiver case 42 via a passive armature support 40', which may also be implemented as a rigid block 40' in such a way that its position is a mirror-reflection of the position of the active U-shaped armature 20. The active and passive armature supports 40 and 40' are affixed to the inner and outer surfaces of the housing 42, respectively, at a common point in the housing 42. The resonance frequency of the passive U-shaped armature 20' should be equal or close to the resonance frequency of the active U-shaped armature 20.

In a preferred embodiment, the passive armature 20' mimics the shape of the active armature 20. This makes it more likely that the passive armature's 20' vibration pattern will mimic that of the active armature 20. However, the design is not so limited, and it is also possible to design a passive armature 20' to be of a different shape, particularly if only narrow bands of frequencies are of concern.

During the receiver 10 operation, the passive U-shaped armature 20' becomes excited by vibrations of the receiver. The directions of vibrations 50' of the passive U-shaped armature 20' become opposite to the directions of vibrations 50 of the active U-shaped armature 20 at the resonance frequency of the U-shaped armatures 20, 20'. Therefore the passive U-shaped armature 20' acts to compensate the receiver vibrations 50 in the region of the U-shape armature resonance and thereby reducing the feedback tendency of a hearing aid.

Optionally, a damper 21' may be provided that allows adjusting the amount of a vibrational compensation and width of the frequency region/band where the compensation takes place. The damper can prevent a situation in which the passive armature 20' begins to vibrate with a very high amplitude, thereby "over-compensating" for the vibration of the active armature 20 by generating excessive opposing vibrations.

Ideally, the damper has high internal friction losses. Such a construction can be realized with a block of viscous material, a drop of a semi-liquid damping fluid, viscous oil, etc.

For the purposes of promoting an understanding of the principles of the invention, reference has been made to the preferred embodiments illustrated in the drawings, and specific language has been used to describe these embodiments.

However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware components configured to perform the specified functions. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". The word mechanism is intended to be used generally and is not limited solely to mechanical embodiments. Numerous modifications and adaptations will be readily apparent to those skilled in this art without departing from the spirit and scope of the present invention.

TABLE OF REFERENCE CHARACTERS

10 hearing aid receiver
20 active U-shaped armature
20' passive U-shaped armature
21' damper
30 reinforcement layer
32 diaphragm layer
36 electric coil
38 magnetic member
40 active armature support
40' passive armature support
42 housing
50 U-shaped armature driven vibration
50' passive armature vibration

What is claimed is:

1. A hearing instrument receiver, comprising:
a housing comprising inner and outer surfaces;
first and second armature support blocks affixed to the inner and outer surfaces of the housing, respectively, at a common point in the housing;
a first armature comprising a body comprising fixed and free ends, where
the first armature lies in a plane defined by its body; and
the fixed end of the first armature is affixed to the first armature support block; and
a second armature comprising fixed and free ends, where
the second armature lies in a plane defined by its body;
the fixed end of the second armature is affixed to the second armature support block; and
the second armature lies in the same plane as the first armature.

2. A hearing instrument receiver as forth in claim 1, where the first armature comprises an active armature and the second armature comprises a passive armature.

3. A hearing instrument receiver as forth in claim 1, where the first and second armatures comprise identically-shaped bodies.

4. A hearing instrument receiver as forth in claim 1, where the first and second armatures comprise U-shaped bodies.

5. A hearing instrument receiver as forth in claim 1, where the first and second armatures are resonant at the same frequencies.

6. A hearing instrument receiver as forth in claim 1, where vibration of the first armature opposes vibration of the second armature.

7. A hearing instrument receiver as forth in claim 1, where the second armature further comprises a damper.

8. A hearing instrument receiver as forth in claim 7, where the damper comprises a viscous material between the fixed and free ends of the second armature.

* * * * *